US008080073B2

(12) United States Patent
David et al.

(10) Patent No.: US 8,080,073 B2
(45) Date of Patent: Dec. 20, 2011

(54) ABRASIVE ARTICLE HAVING A PLURALITY OF PRECISELY-SHAPED ABRASIVE COMPOSITES

(75) Inventors: Moses M. David, Woodbury, MN (US); Scott R. Culler, Burnsville, MN (US); John T. Boden, White Bear Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 553 days.

(21) Appl. No.: 12/140,402

(22) Filed: Jun. 17, 2008

(65) Prior Publication Data

US 2009/0163127 A1 Jun. 25, 2009

Related U.S. Application Data

(60) Provisional application No. 61/015,363, filed on Dec. 20, 2007.

(51) Int. Cl.
*B24B 1/00* (2006.01)

(52) U.S. Cl. ..... 51/295; 451/486

(58) Field of Classification Search ..... 23/293 A; 264/256, 299, 308; 51/295
See application file for complete search history.

(56) References Cited

U.S. PATENT DOCUMENTS 3,962,486 A * 6/1976 Gerek et al. ..... 427/447
4,311,489 A 1/1982 Kressner
4,652,274 A 3/1987 Boettcher et al.
4,652,275 A 3/1987 Bloecher et al.
4,735,632 A 4/1988 Oxman et al.
4,751,138 A 6/1988 Tumey et al.
4,799,939 A 1/1989 Bloecher et al.
4,903,440 A 2/1990 Larson et al.
4,985,340 A 1/1991 Palazzotto et al.
5,061,294 A 10/1991 Harmer et al.
5,137,542 A 8/1992 Buchanan et al.
5,152,917 A 10/1992 Pieper
5,201,101 A 4/1993 Rouser et al.
5,203,884 A 4/1993 Buchanan et al.
5,236,472 A 8/1993 Kirk et al.
5,304,223 A 4/1994 Pieper et al.
5,500,273 A * 3/1996 Holmes et al. ..... 51/295

(Continued)

FOREIGN PATENT DOCUMENTS

WO WO2007/134110 11/2007

OTHER PUBLICATIONS

ASTM D2578-04a "Standard Test Method for Wetting Tension of Polyethylene and Polypropylene Films" © ASTM International, 100 Barr Harbor Drive, PO Box C700, West Conshohocken, PA 19428-2959, United States.

*Primary Examiner* — Jerry Lorengo
*Assistant Examiner* — Ross J Christie
(74) *Attorney, Agent, or Firm* — Scott A. Baum

(57) ABSTRACT

A method of making an abrasive article including the steps of treating a plurality of cavities in a contacting surface of a production tool by plasma deposition of a thin film thereby forming a plurality of plasma treated cavities. Filling the plurality of plasma treated cavities in the production tool with an abrasive slurry, and at least partially curing the abrasive slurry while residing in the plurality of cavities.

12 Claims, 3 Drawing Sheets

U.S. PATENT DOCUMENTS 5,551,959 A * 9/1996 Martin et al. ..... 51/295
5,707,409 A * 1/1998 Martin et al. ..... 51/295
5,888,594 A 3/1999 David et al.
5,948,166 A 9/1999 David et al.
5,958,794 A * 9/1999 Bruxvoort et al. ..... 451/539
5,975,987 A 11/1999 Hoopman et al.
6,821,189 B1 * 11/2004 Coad et al. ..... 451/41
6,841,480 B2 * 1/2005 Simpson et al. ..... 438/691
7,195,360 B2 3/2007 Bacon, Jr. et al.
2003/0134515 A1 7/2003 David et al.
2005/0255801 A1 11/2005 Pollasky
2007/0187359 A1 * 8/2007 Nakagawa et al. ..... 216/41
2007/0187362 A1 * 8/2007 Nakagawa et al. ..... 216/58
2007/0254560 A1 11/2007 Woo et al.

* cited by examiner

ABRASIVE ARTICLE HAVING A PLURALITY OF PRECISELY-SHAPED ABRASIVE COMPOSITES

CROSS-REFERENCE TO RELATED APPLICATION

This application claims the benefit of priority to U.S. Provisional Application No. 61/015,363 entitled Abrasive Article Having A Plurality Of Precisely-Shaped Abrasive Composite Defects filed on Dec. 20, 2007, the disclosure of which is herein incorporated by reference in its entirety.

BACKGROUND

This invention relates to an abrasive article and a method of making an abrasive article. A coated abrasive article typically comprises a plurality of abrasive particles bonded to a backing by means of one or more binders. In some instances, it is desirable to mold a coated abrasive to impart a pattern on its abrasive surface. The molding process can provide a coating having a plurality of precisely-shaped abrasive composites formed from an abrasive slurry.

Abrasive articles suitable for removing defects in the painted automotive panels of new cars on an assembly line, and/or during body shop repairs, can have the number of precisely-shaped abrasive composites equal to or greater than 1,200 per square cm. As the number of precisely-shaped abrasive composites increases per square cm, it becomes increasing difficult to form the precisely-shaped abrasive composites without defects or voids in the surface of the precisely-shaped abrasive composites. The defects or voids can result in inconsistent or degraded performance of the abrasive article during use. Therefore, what is needed is a method for making defect-free precisely-shaped abrasive composites; especially, as the density of the composites equals or exceeds 1,200 composites per square cm.

SUMMARY

The inventors have discovered that by subjecting the contacting surface of a production tool to a plasma treatment, fewer voids or defects in the resulting precisely-shaped abrasive composites occur. It is believed that the reduction in defects is due in part to changing the wetting tension of the contacting surface of the production tooling.

The surface of a production tool that comes into contact with an abrasive slurry that is cured to form the precisely-shaped abrasive composites contains cavities or recesses that are disposed in a pattern. The internal surfaces of the cavities are treated with plasma deposition of a thin film. The plasma deposition thin film layer helps the abrasive slurry that is deposited into the cavities to wet into and better fill out these cavities; especially, as the cavity size is deceased resulting in significantly fewer precisely-shaped abrasive composite defects. As the binder precursor is at least partially cured on the surface of the production tool, the resulting abrasive article will have a more defect-free topographical pattern essentially corresponding to the inverse of the pattern on the production tool. In one embodiment for abrasive composites having a pyramidal shape, a thin film layer plasma deposition on the cavities results in significantly more abrasive composites having a fully formed apex. This reduction in defects in the apexes of the abrasive composites can be especially noticeable when the density of the abrasive composites equals or exceeds 1,200 per square cm.

Hence in one aspect, the present disclosure resides in an abrasive article comprising a sheet-like structure having a major surface and having deployed in a fixed position thereon a plurality of precisely-shaped abrasive composites in an area spacing. Each of the precisely-shaped abrasive composites comprises a plurality of abrasive particles dispersed in a binder and the abrasive article has a Precisely-Shaped Abrasive Composite Defect Rate of between 0 percent to about 30 percent.

In another embodiment, the present disclosure resides in a method of making an abrasive article comprising: treating a plurality of cavities in a contacting surface of a production tool by plasma deposition of a thin film thereby forming a plurality of plasma treated cavities, mixing an abrasive slurry comprising abrasive particles and a binder precursor and filling the plurality of plasma treated cavities in the production tool with the abrasive slurry, contacting the abrasive slurry with a backing, and at least partially curing the binder precursor to form a shaped handleable structure and separating the shaped, handleable structure from the production tool.

BRIEF DESCRIPTION OF THE DRAWINGS

It is to be understood by one of ordinary skill in the art that the present discussion is a description of exemplary embodiments only, and is not intended as limiting the broader aspects of the present invention, which broader aspects are embodied in the exemplary construction.

Figure 1:
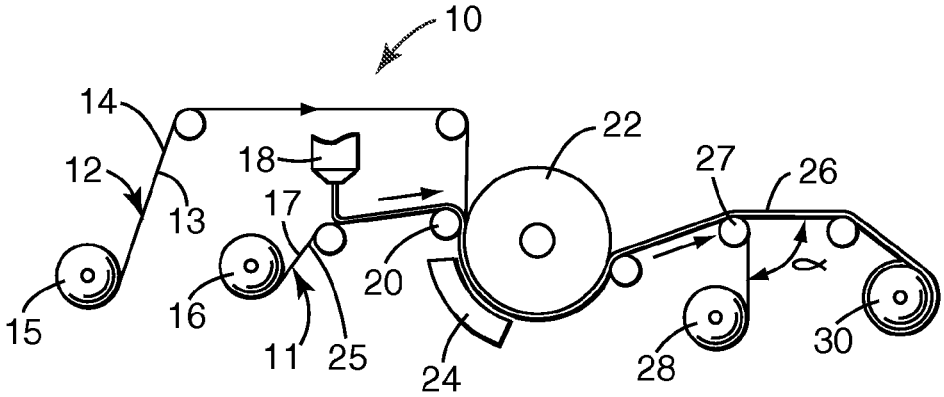
FIG. 1 is a schematic view of an apparatus for preparing an abrasive article.

Repeated use of reference characters in the specification and drawings is intended to represent the same or analogous features or elements of the invention.

DEFINITIONS

As used herein, forms of the words "comprise", "have", and "include" are legally equivalent and open-ended. Therefore, additional non-recited elements, functions, steps or limitations may be present in addition to the recited elements, functions, steps, or limitations.

As used herein, the term "abutting" means that adjacent abrasive composites have at least portions, e.g., the base portions that are in physical contact. In one embodiment of the abrasive article, this physical contact involves no more than 33% of the vertical height dimension of each contacting composite. Typically, the amount of physical contact between the abutting composites is in the range of 1 to 25% of the vertical height of each contacting composite. It is to be understood that this definition of abutting also covers an arrangement where adjacent composites share a common abrasive material land or bridge-like structure which contacts and extends between facing sidewalls of the composites. Typically, the land structure has a height of no greater than 33% of the vertical height dimension of each adjacent composite. The abrasive material land is formed from the same abrasive slurry used to form the abrasive composites. The composites are "adjacent" in the sense that no intervening composite is located on a direct imaginary line drawn between the centers of the composites.

As used herein, a "precisely-shaped abrasive composite" is formed by an abrasive slurry residing in a cavity in a mold that is at least partially cured before being removed from the mold such that the resulting abrasive composite substantially replicates the surface finish and/or shape of the cavity.

As used herein, "precisely-shaped abrasive composite defect" means an unintentional depression, air-void, or bubble in the surface of the precisely-shaped abrasive composite that typically varies in location and/or size from one precisely-shaped abrasive composite to the next. By looking at the overall shape and pattern of many precisely-shaped abrasive composites in the abrasive article, the precisely-shaped abrasive composite defects are readily discernable when comparing the individual precisely-shaped abrasive composites in the array. In some embodiments, the precisely-shaped abrasive composite defect results in a missing apex of a pyramidal shaped precisely-shaped abrasive composite such that the composite resembles a volcano with a depression where the apex should be.

DETAILED DESCRIPTION

Method of Making an Abrasive Article

FIG. 1 illustrates an apparatus 10 for making an abrasive article. A production tool 11 is in the form of a belt having two major surfaces and two ends. A backing 12 having a front surface 13 and a back surface 14 leaves an unwind station 15. At the same time, the production tool 11 leaves an unwind station 16. The contacting surface 17 of production tool 11 is coated with a mixture of abrasive particles and binder precursor at coating station 18. The mixture can be heated to lower the viscosity thereof prior to the coating step. The coating station 18 can comprise any conventional coating means, such as knife coater, drop die coater, curtain coater, vacuum die coater, or an extrusion die coater. After the contacting surface 17 of production tool 11 is coated, the backing 12 and the production tool 11 are brought together such that the mixture wets the front surface 13 of the backing 12. In FIG. 1, the mixture is forced into contact with the backing 12 by means of a contact nip roll 20, which also forces the production tool/mixture/backing construction against a support drum 22. Next, a sufficient dose of radiation energy is transmitted by a source of radiation energy 24 through the back surface 25 of production tool 11 and into the mixture to at least partially cure the binder precursor, thereby forming a shaped, handleable structure 26. The production tool 11 is then separated from the shaped, handleable structure 26. Separation of the production tool 11 from the shaped, handleable structure 26 occurs at roller 27. The angle $\alpha$ between the shaped, handleable structure 26 and the production tool 11 immediately after passing over roller 27 is steep in one embodiment, e.g., in excess of 30 degrees, in order to bring about clean separation of the shaped, handleable structure 26 from the production tool 11. The production tool 11 is rewound on mandrel 28 so that it can be reused. Shaped, handleable structure 26 is wound on mandrel 30.

If the binder precursor has not been fully cured, it can then be fully cured by exposure to an additional energy source, such as a source of thermal energy or an additional source of radiation energy, to form the coated abrasive article. Alternatively, full cure may eventually result without the use of an additional energy source to form the coated abrasive article. As used herein, the phrase "full cure" and the like means that the binder precursor is sufficiently cured so that the resulting product will function as an abrasive article, e.g. a coated abrasive article. After the abrasive article is formed, it can be flexed and/or humidified prior to converting. The abrasive article can be converted into any desired form such as a cone, endless belt, sheet, disc, etc. before use.

Figure 2:
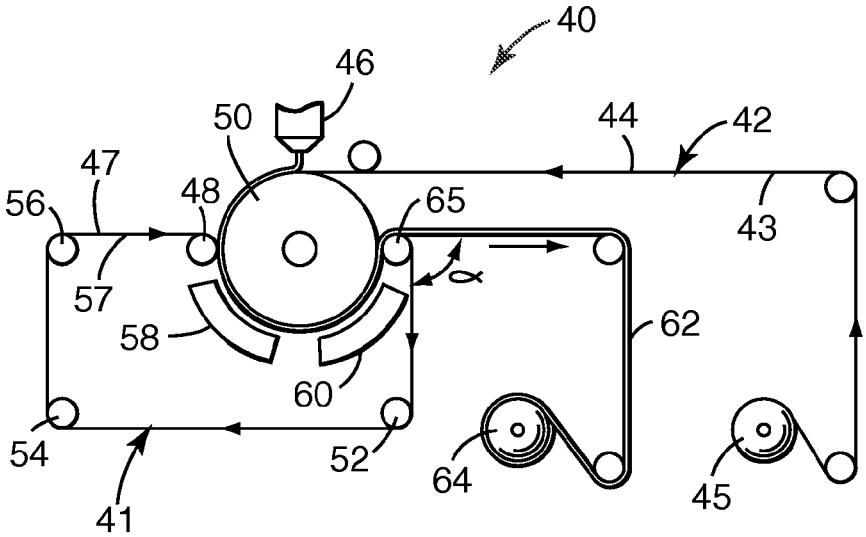
FIG. 2 is a schematic view of another apparatus for preparing an abrasive article.

FIG. 2 illustrates an apparatus 40 for an alternative method of preparing an abrasive article. In this apparatus, the mixture is coated onto the backing rather than onto the production tool. In this apparatus, the production tool 41 is an endless belt having a front surface and a back surface. A backing 42 having a back surface 43 and a front surface 44 leaves an unwind station 45. The front surface 44 of the backing is coated with a mixture of abrasive particles and binder precursor at a coating station 46. The mixture is forced against the contacting surface 47 of the production tool 41 by means of a contact nip roll 48, which also forces the production tool/mixture/backing construction against a support drum 50, such that the mixture wets the contacting surface 47 of the production tool 41. The production tool 41 is driven over three rotating mandrels 52, 54, and 56. Radiation energy is then transmitted through the back surface 57 of production tool 41 and into the mixture to at least partially cure the binder precursor. There may be one source of radiation energy 58. There may also be a second source of radiation energy 60. These energy sources may be of the same type or of different types.

After the binder precursor is at least partially cured, the shaped, handleable structure 62 is separated from the production tool 41 and wound upon a mandrel 64. Separation of the production tool 41 from the shaped, handleable structure 62 occurs at roller 65. The angle $\alpha$ between the shaped, handleable structure 62 and the production tool 41 immediately after passing over roller 65 is steep in one embodiment, e.g., in excess of 30 degrees in order to bring about clean separation of the shaped, handleable structure 62 from the production tool 41.

If the binder precursor has not been fully cured, it can then be fully cured by exposure to an additional energy source, such as a source of thermal energy or an additional source of radiation energy, to form the coated abrasive article. Alternatively, full cure may eventually result without the use of an additional energy source to form the coated abrasive article. After the abrasive article is formed, it can be flexed and/or humidified prior to converting. The abrasive article can be converted into any desired form such as a cone, endless belt, sheet, disc, etc. before use.

The abrasive slurry used to form the precisely-shaped abrasive composites comprises a plurality of abrasive particles dispersed in a binder precursor. As used herein, the term "mixture" means any composition comprising a plurality of abrasive particles dispersed in a binder precursor. In one embodiment, the mixture is flowable. However, if the mixture is not flowable, it can be extruded or forced by other means, e.g. heat or pressure or both, onto the contacting surface of the production tool or onto the front surface of the backing. The mixture can be characterized as being conformable, that is, it can be forced to take on the same shape, outline, or contour as the contacting surface of the production tool and the front surface of the backing.

The binder precursor is capable of being cured by energy such as radiation energy. The radiation energy can be from ultraviolet light, visible light, or electron beam sources. Other sources of energy include infrared, thermal, and microwave.

In one embodiment, the energy does not adversely affect the production tool that is used such that the tool can be reused. The binder precursor can polymerize via a free radical mechanism or a cationic mechanism. Examples of binder precursors that are capable of being polymerized by exposure to radiation energy include acrylated urethanes, acrylated epoxies, ethylenically unsaturated compounds, aminoplast derivatives having pendant unsaturated carbonyl groups, isocyanurate derivatives having at least one pendant acrylate group, isocyanate derivatives having at least one pendant acrylate group, vinyl ethers, epoxy resins, and combinations thereof. The term "acrylate" includes acrylates and methacrylates.

If either ultraviolet radiation or visible radiation is to be used, in one embodiment, the binder precursor further comprises a photoinitiator. Examples of photoinitiators that generate a free radical source include, but are not limited to, organic peroxides, azo compounds, quinones, benzophenones, nitroso compounds, acyl halides, hydrazones, mercapto compounds, pyrylium compounds, triacrylimidazoles, bisimidazoles, phosphene oxides, chloroalkyltriazines, benzoin ethers, benzil ketals, thioxanthones, acetophenone derivatives, and combinations thereof.

Cationic photoinitiators generate an acid source to initiate the polymerization of an epoxy resin. Cationic photoinitiators can include a salt having an onium cation and a halogen containing a complex anion of a metal or metalloid. Other cationic photoinitiators include a salt having an organometallic complex cation and a halogen containing complex anion of a metal or metalloid. These are further described in U.S. Pat. No. 4,751,138 to Tumey, (column 6, line 65 to column 9, line 45). Another example of a cationic photoinitiator is an organometallic salt and an onium salt described in U.S. Pat. No. 4,985,340 to Palazzotto (column 4, line 65 to column 14, line 50). Still other cationic photoinitiators include an ionic salt of an organometallic complex in which the metal is selected from the elements of Periodic Group IVB, VB, VIIB, VIIB and VIIIB.

In addition to the radiation curable resins, the binder precursor may further comprise resins that are curable by sources of energy other than radiation energy, such as condensation curable resins. Examples of such condensation curable resins include phenolic resins, melamine-formaldehyde resins, and urea-formaldehyde resins.

The abrasive slurry can be prepared by mixing the ingredients, preferably by a low shear mixer. A high shear mixer can also be used. Typically, the abrasive particles are gradually added into the binder precursor. Additionally, it is possible to minimize the amount of air bubbles in the mixture. This can be accomplished by pulling a vacuum during the mixing step.

During the manufacture of the shaped, handleable structure, radiation energy is desirably transmitted through the production tool and into the mixture to at least partially cure the binder precursor. The phrase "partial cure" means that the binder precursor is polymerized to such a state that the resulting mixture releases from the production tool. The binder precursor can be fully cured once it is removed from the production tool by any energy source, such as, for example, thermal energy or radiation energy. The binder precursor can also be fully cured before the shaped, handleable structure is removed from the production tool.

Suitable sources of radiation energy include, for example, electron beam, ultraviolet light, and visible light. Other sources of radiation energy include infrared and microwave. Thermal energy can also be used. Electron beam radiation, which is also known as ionizing radiation, can be used at a dosage of about 0.1 to about 10 Mrad, preferably at a dosage of about 1 to about 10 Mrad. Ultraviolet radiation refers to non-particulate radiation having a wavelength within the range of about 200 to about 400 nanometers, preferably within the range of about 250 to 400 nanometers. In one embodiment, the ultraviolet radiation can be provided by ultraviolet lights at a dosage of 100 to 300 Watts/cm. Visible radiation refers to non-particulate radiation having a wavelength within the range of about 400 to about 800 nanometers, and in one embodiment, within the range of about 400 to about 550 nanometers.

Typically, the radiation energy is transmitted through the production tool and directly into the mixture. In one embodiment, the material from which the production tool is made does not absorb an appreciable amount of radiation energy or become degraded by radiation energy. In one embodiment, if electron beam energy is used, the production tool is not made from a cellulosic material because the electrons will degrade the cellulose. If ultraviolet radiation or visible radiation is used, the production tool material should transmit sufficient ultraviolet or visible radiation, respectively, to bring about the desired level of cure.

The production tool should be operated at a velocity that is sufficient to avoid degradation by the source of radiation. Production tools that have relatively high resistance to degradation by the source of radiation can be operated at relatively lower velocities; production tools that have relatively low resistance to degradation by the source of radiation can be operated at relatively higher velocities. In short, the appropriate velocity for the production tool depends on the material from which the production tool is made.

The production tool can be in the form of a belt, e.g., an endless belt, a sheet, a continuous sheet or web, a coating roll, a sleeve mounted on a coating roll, or die. The surface of the production tool that will come into contact with the mixture can be smooth or can have a topography or pattern. This surface is referred to herein as the "contacting surface". If the production tool is in the form of a belt, sheet, web, or sleeve, it will have a contacting surface and a non-contacting surface. If the production tool is in the form of a roll, it will have a contacting surface only. The topography of the abrasive article formed by the method will have the inverse of the pattern of the contacting surface of the production tool. The pattern of the contacting surface of the production tool will generally be characterized by a plurality of cavities or recesses. The opening of these cavities can have any shape, regular or irregular, such as a rectangle, semicircle, circle, triangle, square, hexagon, octagon, etc. The walls of the cavities can be vertical or tapered. The pattern formed by the cavities can be arranged according to a specified plan or can be random. Desirably, the cavities can butt up against one another.

Figure 3:
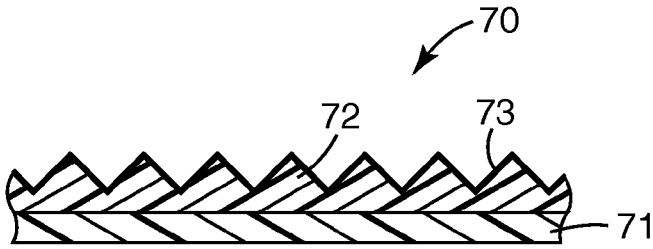
FIG. 3 is a sectional view of a segment of a production tool useful for making an abrasive article.

Thermoplastic materials that can be used to construct the production tool include polyesters, polycarbonates, poly (ether sulfone), poly(methyl methacrylate), polyurethanes, polyvinylchloride, polyolefins, polystyrene, or combinations thereof. Thermoplastic materials can include additives such as plasticizers, free radical scavengers or stabilizers, thermal stabilizers, antioxidants, and ultraviolet radiation absorbers. These materials are substantially transparent to ultraviolet and visible radiation. One type of production tool is illustrated in FIG. 3. The production tool 70 can comprise three layers 71, 72, and 73. The surface of layer 71 is relatively flat and smooth. The surface of layer 72 has a pattern and layer 73 comprises a plasma deposition of a thin film.

Layer 71 exhibits high heat resistance and strength. Examples of materials suitable for layer 71 include polycarbonate and polyester. Layer 72 exhibits low surface energy.

The material of low surface energy improves ease of release of the abrasive article from the production tool. Examples of materials suitable for layer 72 include polypropylene and polyethylene. In some production tools made of thermoplastic material, the operating conditions for making the abrasive article should be set such that excessive heat is not generated. If excessive heat is generated, this may distort or melt the thermoplastic tooling. In some instances, ultraviolet light generates heat. It should also be noted that a production tool comprising layer 72 and layer 73 is also acceptable.

A thermoplastic production tool can be made according to the following procedure. A master tool is first provided. The master tool is typically made from metal, e.g., nickel. The master tool can be fabricated by any conventional technique, such as engraving, hobbing, knurling, electroforming, diamond turning, laser machining, etc. If a pattern is desired on the surface of the production tool, the master tool should have the inverse of the pattern for the production tool on the surface thereof. The thermoplastic material can be embossed with the master tool to form the pattern. Embossing can be conducted while the thermoplastic material is in a flowable state. After being embossed, the thermoplastic material can be cooled to bring about solidification.

The production tool can also be made of a cured thermosetting resin. A production tool made of thermosetting material can be made according to the following procedure. An uncured thermosetting resin is applied to a master tool of the type described previously. While the uncured resin is on the surface of the master tool, it can be cured or polymerized by heating such that it will set to have the inverse shape of the pattern of the surface of the master tool. Then, the cured thermosetting resin is removed from the surface of the master tool. The production tool can be made of a cured radiation curable resin, such as, for example acrylated urethane oligomers. Radiation cured production tools are made in the same manner as production tools made of thermosetting resin, with the exception that curing is conducted by means of exposure to radiation e.g. ultraviolet radiation.

At least the contacting surface (17, 47) of the production tool including the cavities, (the surface in contact with the abrasive slurry as it is cured), comprises a layer 73 of a plasma deposited thin film. The release properties of the production tools may be altered by depositing a thin film on the contacting surfaces of the tool from a gas phase using a plasma treatment process. To alter the release properties of the production tool's contacting surface, the plasma deposited thin film typically is about 1 nm to about 1000 nm thick, or about 1 nm to about 100 nm thick, or about 50 to about 100 nm thick.

In one embodiment, the contacting surface of the production tool may be treated by plasma deposition of a silicon-containing thin film. The silicon-containing thin film may be amorphous hydrogenated silicon oxycarbide. The silicon-containing thin film may be deposited from organosilane or a silane precursor gas. In some embodiments, the silicon-containing precursor gas is reacted with other gases such as nitrogen, oxygen, or combinations thereof.

In contrast to silicones, oils, or other release agents applied to the contacting surface, the plasma deposition treatment does not contaminate, leave a residue, or otherwise alter the chemistry of the abrasive slurry molded by the contacting surface. This can be especially important for abrasive articles used in certain industries where even trace amounts of silicone acts as a contaminant and can be problematic.

During plasma treatment, plasma created in the apparatus from the gas within the chamber is generated and sustained by supplying power (for example, from an RF generator operating at a frequency in the range of 0.001 to 100 MHz) to at least one electrode. The electrode system may be symmetric or asymmetric. In some plasma apparatus, electrode surface area ratios between grounded and powered electrodes are from 2:1 to 4:1, or from 3:1 to 4:1. The powered electrode may be cooled, e.g., with water. For discrete planar articles, plasma deposition can be achieved, for example, by placing the articles in direct contact with the smaller electrode of an asymmetric electrode configuration. This allows the article to act as an electrode due to capacitive coupling between the powered electrode and the article.

The RF power source provides power at a typical frequency in the range of 0.01 to 50 MHz, or 13.56 MHz or any whole number (e.g., 1, 2, or 3) multiple thereof. The RF power source can be an RF generator such as a 13.56 MHz oscillator. To obtain efficient power coupling (i.e., wherein the reflected power is a small fraction of the incident power), the power source may be connected to the electrode via a network that acts to match the impedance of the power supply with that of the transmission line (which is usually 50 ohms reactive) so as to effectively transmit RF power through a coaxial transmission line. One type of matching network, which includes two variable capacitors and an inductor, is available under the designation AMN 3000 from Plasmatherm of St. Petersburg, Fla. Traditional methods of power coupling involve the use of a blocking capacitor in the impedance matching network between the powered electrode and the power supply. This blocking capacitor prevents the DC bias voltage from being shunted out to the rest of the electrical circuitry. Instead, the DC bias voltage is shunted out in a grounded electrode. While the acceptable frequency range from the RF power source may be high enough to form a large negative DC self bias on the smaller electrode, it should not be so high that it creates standing waves in the resulting plasma, which is inefficient for plasma treatment.

In one embodiment, at least the contacting surface of the production tooling is exposed to a mixture of silicon-containing first gas and a reactive second gas such as oxygen or nitrogen. Typically the first plasma gas is selected from the group consisting of silanes or siloxanes, and the second reactive gas is selected from the group consisting of oxygen, nitrogen, ammonia, nitrogen dioxide, nitrous oxide, or sulfur dioxide. Typically, the first plasma gas is of a species including a silane, most typically tetramethylsilane (TMS), and the second plasma gas is of a species including oxygen. The ratio of the silicon-containing first gas to the second reactive gas is adjusted to provide the surface energy needed on the production tooling surface. Typical ratios for the flow rate of the silicon-containing first gas divided by the flow rate of the second reactive gas, such as O2 or N2, are between about 0.05 to about 0.35 or between about 0.05 to about 0.25. Power and duration of exposure are adjusted to provide a sufficiently thick film to ensure durability of the treated tool.

In various embodiments, organosilanes that may be used for plasma deposition include, but are not limited to, tetramethylsilane, methylsilane, dimethylsilane, trimethylsilane, ethylsilane, tetraethylorthosilicate (TEOS), tetramethylcyclotetrasiloxane (TMCTS), disilanomethane, bis(methylsilano)methane, 1,2-disilanoethane, 1,2-bis(methylsilano) ethane, 2,2-disilanopropane, diethylsilane, diethylmethylsilane, propylsilane, vinylmethylsilane, divinyldimethylsilane, 1,1,2,2-tetramethyldisilane, hexamethyldisilane, 1,1,2,2,3,3-hexamethyltrisilane, 1,1,2,3,3-pentamethyltrisilane, dimethyldisilanoethane, dimethyldisilanopropane, tetramethyldisilanoethane, tetramethyldisilanopropane, and the like, or combinations of two or more of the foregoing.

Typically, the contacting surface (17, 47) of the tool is plasma treated for about 0.1 minute to about 10 minutes, or for about 0.1 minute to about 2 minutes. Exemplary process conditions for batch treatment plasma deposition of the contacting surfaces of the production tool with TMS are as follows: TMS flow rate of 50 sccm; oxygen flow rate of 500 sccm; pressure of 55 mTorr; power density of 1000 watts; and plasma treatment time of 60 seconds.

In addition to batch treatment of the production tooling, rolls or continuous webs of the production tooling can be treated using a continuous plasma reactor using techniques as described in U.S. Pat. Nos. 5,888,594; 5,948,166; 7,195,360; and in U.S. patent publication number US 2003/0134515. A continuous plasma treatment apparatus typically includes a rotating drum electrode which may be powered by a radio frequency (RF) power source, a grounded chamber which acts as a grounded electrode, a feed reel which continuously supplies to-be-treated articles in the form of a continuous moving web, and a take-up reel which collects the treated article. The feed and take up reels are optionally enclosed within the chamber, or can be operated outside of the chamber as long as a low-pressure plasma can be maintained within the chamber. If desired, a concentric grounded electrode can be added near the powered drum electrode for additional spacing control. A mask can be employed if desired to provide discontinuous treatment. An inlet supplies suitable treatment gases in vapor or liquid form to the chamber.

Abrasive Article

Figure 4:
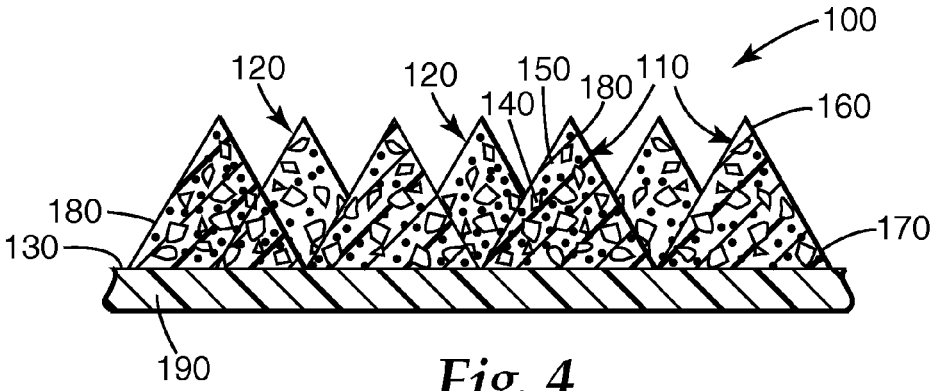
FIG. 4 is an enlarged end sectional profile view representing one embodiment of an abrasive article.

Referring to FIG. 4, abrasive article 100 has a backing 190 having a front surface 130 having a plurality of precisely-shaped abrasive composites 110 bonded thereto. The front surface 130 extends within an imaginary plane. As shown in FIG. 1, each of the precisely-shaped abrasive composites abuts an adjacent composite near the bottom portions thereof (the lowermost portions of which are in contact with the backing).

In one embodiment, the amount of physical contact between the abutting composites in the abrasive article does not exceed 33% of the vertical height of either of the given contacting or abutting composites as measured from the front surface of the backing. That is, the height dimensions described herein on the abutting contact applies to each adjacent composite, not merely one. If the abutting composites contact in amounts exceeding 33% of the vertical height of each composite, the swarf discharge capability of the abrasive article may be adversely impacted to cause loading problems. Loading is a problem caused by filling of spaces between abrasive features with swarf (i.e., material removed from the workpiece being abraded) and the subsequent build-up of that material. This build-up of such loose abraded material can lodge between the abrasive features to impair the cutting ability of the abrasive features. On the other hand, some physical contact is required between adjacent abrasive composites to facilitate providing a high areal density of the composites over the surface of the backing. A higher areal density of composites tends to produce a lower unit pressure per composite during abrading, thereby allowing a finer surface finish. In one embodiment, the amount of physical contact between the abutting composites is in the range of 1 to 25% of the vertical height of each contacting composite.

Figure 5:
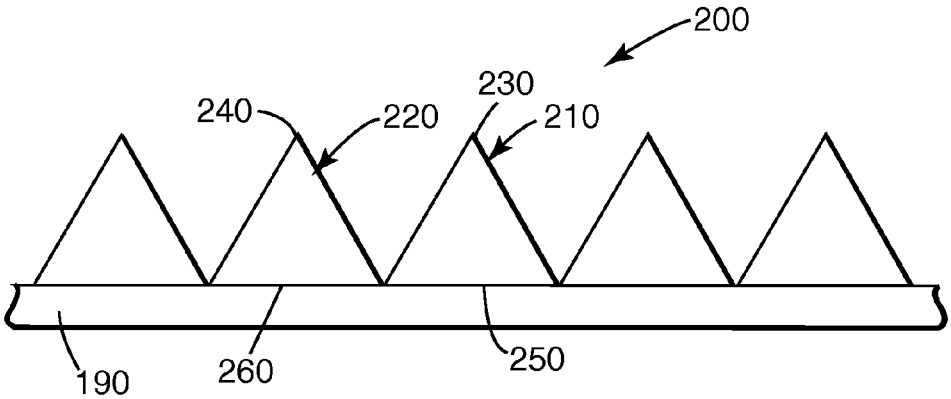
FIG. 5 is an enlarged end sectional profile view representing another embodiment of an abrasive article.

Also, the definition of "abutting" not only encompasses the arrangement of composites such as depicted in FIGS. 4 and 5, but also covers an arrangement where adjacent abrasive composites (at least two) share a common abrasive material land or bridge-like structure which contacts and extends between facing sidewalls of the adjacent composites. The abrasive material land is formed from the same slurry as which forms the abrasive composites. The land structures can have a height from the backing which is no more than 33% or 1 to 25%, of the height of each adjacent composite. For example, in adjacent composites having the same pyramidal shape with a height of approximately 79 micrometers and base edge lengths of approximately 178 micrometers, the land can have a height of approximately 20 micrometers, a length of approximately 25 micrometers, and a width no greater than 178 micrometers (the based edge length).

An abrasive article employing at least 1,200 abutting composites per square cm or greater provides an advantageous cut rate while providing a finer finish for removing defects in painted automotive panels. As shown in FIG. 4, the precisely-shaped abrasive composites comprise a plurality of abrasive particles 140 dispersed in the binder 150. The bottom surface 170 of the abrasive composite is in planar contact with the front surface 130 of the backing 190, and it has a total given surface area defined by those bottom surface portions of the base side which are in intimate contact with the backing. Distal end 160 is spaced from the backing 190 and is unconnected to the ends of any other composites in the array. The distal end 160 has a given total surface area located within another imaginary plane that extends parallel to the front surface. It will be understood that if the composite has a pyramidal shape which terminates in an apex point spaced away from the backing that the surface area of such an apex will be exceedingly small and approach a value of zero.

In one embodiment, the surface area of the base side of each of the composites is equal to or greater in amount than that of the distal end. In another embodiment, the precise shapes of the composites are tapered. The surface area of the base side is greater than the surface area of any other cross-sectional slice of the composite taken in a plane parallel to and vertically spaced from said interface of the base side and the backing.

The expression precisely-shaped, can be used to describe the abrasive composites having a three dimensional shape that are defined by relatively smooth-surfaced sides that are bounded and joined by well-defined sharp edges having distinct edge lengths with distinct endpoints defined by the intersections of the various sides. The abrasive article is referred to as "structured" in the sense of the deployment of a plurality of such precisely-shaped abrasive composites in a predetermined array on the backing. Such a precise shape can be formed, for example, by curing the curable binder of a flowable mixture of abrasive particles and curable binder while the mixture is both being formed on a backing and filling a cavity on the surface of a production tool.

The term "boundary", when used to define the abrasive composites, means the exposed surfaces and edges of each composite that delimit and define the actual three-dimensional shape of each abrasive composite. These boundaries are readily visible and discernible when a cross-section of an abrasive article of this invention is viewed under a scanning electron microscope. These boundaries separate and distinguish one abrasive composite from another even if the composites abutt each other along a common border at their bases. By comparison, in an abrasive composite that does not have a precise shape, the boundaries and edges are not definitive, e.g., where the abrasive composite sags before completion of its curing.

The backing has a front and back surface and can be any conventional abrasive backing. Examples of such include polymeric film, primed polymeric film, cloth, paper, vulcanized fiber, nonwovens, and combinations thereof. The backing may also contain a known treatment or treatments to seal the backing and/or modify some physical properties of the backing. The backing may also have an attachment means on its back surface to secure the resulting coated abrasive to a support pad or back-up pad. This attachment means can be a pressure sensitive adhesive or a loop fabric for a hook and loop attachment. Alternatively, there may be an intermeshing attachment system as described in U.S. Pat. No. 5,201,101 to Rouser.

The back side of the abrasive article may also contain a slip resistant or frictional coating. Examples of such coatings include an inorganic particulate (e.g., calcium carbonate or quartz) dispersed in an adhesive. The back side of the backing may be printed with pertinent information according to conventional practice to reveal information such as product identification number, grade number, manufacturer and the like. Alternatively, the front surface of the backing may be printed with this same type of information. The front surface can be printed if the abrasive composite is translucent enough for print to be legible through the abrasive composites.

The abrasive particles dispersed in the composite binder of the invention generally have a particle size ranging from about 0.1 to 1500 micrometers, usually between about 0.1 to 400 micrometers, preferably between 0.1 to 100 micrometers and most preferably between 0.1 to 50 micrometers. It is preferred that the abrasive particles have a Mohs' hardness of at least about 8, more preferably above 9. Examples of such abrasive particles include fused aluminum oxide (which includes brown aluminum oxide, heat treated aluminum oxide, and white aluminum oxide), ceramic aluminum oxide, green silicon carbide, silicon carbide, chromia, alumina zirconia, diamond, silica, iron oxide, ceria, cubic boron nitride, boron carbide, garnet, and combinations thereof. The term abrasive particles also encompasses the arrangement where single abrasive particles are bonded together to form an abrasive agglomerate. Abrasive agglomerates are further described in U.S. Pat. No. 4,311,489 to Kressner; U.S. Pat. No. 4,652,275 to Bloecher and U.S. Pat. No. 4,799,939 to Bloecher.

It is also possible to have a surface coating on the abrasive particles. The surface coating may have many different functions. In some instances the surface coatings increase adhesion to the binder, alter the abrading characteristics of the abrasive particle and the like. Examples of surface coatings include coupling agents, halide salts, metal oxides including silica, refractory metal nitrides, refractory metal carbides and the like.

In the abrasive composite, there may also be diluent particles. The particle size of these diluent particles may be on the same order of magnitude as the abrasive particles. Examples of such diluent particles include gypsum, marble, limestone, flint, silica, glass bubbles, glass beads, aluminum silicate, and the like.

The abrasive particles are dispersed in an organic binder to form the abrasive composite. The organic binder can be a thermoplastic binder or a thermosetting binder. The binder is formed from a binder precursor. During the manufacture of the abrasive article, the thermosetting binder precursor is exposed to an energy source which aids in the initiation of the polymerization or curing process. Examples of energy sources include thermal energy and radiation energy which includes electron beam, ultraviolet light, and visible light.

After this polymerization process, the binder precursor is converted into a solidified binder. Alternatively for a thermoplastic binder precursor, during the manufacture of the abrasive article the thermoplastic binder precursor is cooled to a degree that results in solidification of the binder precursor. Upon solidification of the binder precursor, the abrasive composite is formed.

The binder in the abrasive composite is generally also responsible for adhering the abrasive composite to the front surface of the backing. However, in some instances there may be an additional adhesive layer between the front surface of the backing and the abrasive composite.

There are two main classes of thermosetting resins, condensation curable and addition polymerized resins. In one embodiment, the binder precursors are addition polymerized resin because they are readily cured by exposure to radiation energy. Addition polymerized resins can polymerize through a cationic mechanism or a free radical mechanism. Depending upon the energy source that is utilized and the binder precursor chemistry, a curing agent, initiator, or catalyst is sometimes preferred to help initiate the polymerization.

Examples of typical binders precursors include, for example, phenolic resins, urea-formaldehyde resins, melamine formaldehyde resins, acrylated urethanes, acrylated epoxies, ethylenically unsaturated compounds, aminoplast derivatives having pendant alpha.,.beta.-unsaturated carbonyl groups, isocyanurate derivatives having at least one pendant acrylate group, isocyanate derivatives having at least one pendant acrylate group, vinyl ethers, epoxy resins, and mixtures and combinations thereof. The term acrylate encompasses acrylates and methacrylates.

Phenolic resins are suitable and have good thermal properties, availability, and relatively low cost and ease of handling. There are two types of phenolic resins, resole and novolac. Resole phenolic resins have a molar ratio of formaldehyde to phenol of greater than or equal to one to one, typically between 1.5:1.0 to 3.0:1.0. Novolac resins have a molar ratio of formaldehyde to phenol of less than one to one. Examples of commercially available phenolic resins include those known by the tradenames "Durez" and "Varcum" from Occidental Chemicals Corp.; "Resinox" from Monsanto; "Aerofene" from Ashland Chemical Co. and "Arotap" from Ashland Chemical Co.

Acrylated urethanes are diacrylate esters of hydroxy terminated NCO extended polyesters or polyethers. Examples of commercially available acrylated urethanes include UVITHANE 782, available from Morton Thiokol Chemical, and CMD 6600, CMD 8400, and CMD 8805, available from Radcure Specialties.

Acrylated epoxies are diacrylate esters of epoxy resins, such as the diacrylate esters of bisphenol A epoxy resin. Examples of commercially available acrylated epoxies include CMD 3500, CMD 3600, and CMD 3700, available from Radcure Specialties.

Ethylenically unsaturated resins include both monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups. Ethylenically unsaturated compounds in one embodiment have a molecular weight of less than about 4,000 and are esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of acrylate resins include methyl methacrylate, ethyl methacrylate styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol methacrylate, pentaerythritol tetraacrylate and pentaerythritol tetraacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryloyl-oxyethyl) isocyanurate, 1,3,5-tri(2-methyacryloxyethyl)-s-triazine, acrylamide, methylacrylamide, N-methylacrylamide, N,N-dimethylacrylamide, N-vinylpyrrolidone, and N-vinylpiperidone.

The aminoplast resins have at least one pendant .alpha., .beta.-unsaturated carbonyl group per molecule or oligomer. These unsaturated carbonyl groups can be acrylate, methacrylate, or acrylamide type groups. Examples of such materials include N-(hydroxymethyl)-acrylamide, N,N'-oxydimethylenebisacrylamide, ortho and para acrylamidomethylated phenol, acrylamidomethylated phenolic novolac, and combinations thereof. These materials are further described in U.S. Pat. Nos. 4,903,440 and 5,236,472 to Kirk.

Isocyanurate derivatives having at least one pendant acrylate group and isocyanate derivatives having at least one pendant acrylate group are further described in U.S. Pat. No. 4,652,274 to Boettcher. The preferred isocyanurate material is a triacrylate of tris(hydroxy ethyl)isocyanurate.

Epoxy resins have an oxirane and are polymerized by the ring opening. Such epoxide resins include monomeric epoxy resins and oligomeric epoxy resins. Examples of some preferred epoxy resins include 2,2-bis[4-(2,3-epoxypropoxy)-phenyl propane] (diglycidyl ether of bisphenol) and commercially available materials under the trade designation "Epon 828", "Epon 1004", and "Epon 1001F" available from Shell Chemical Co., "DER-331", "DER-332", and "DER-334" available from Dow Chemical Co. Other suitable epoxy resins include glycidyl ethers of phenol formaldehyde novolac (e.g., "DEN-431" and "DEN-428" available from Dow Chemical Co.).

The epoxy resins can polymerize via a cationic mechanism with the addition of an appropriate cationic curing agent. Cationic curing agents generate an acid source to initiate the polymerization of an epoxy resin. These cationic curing agents can include a salt having an onium cation and a halogen containing a complex anion of a metal or metalloid.

Other cationic curing agents include a salt having an organometallic complex cation and a halogen containing complex anion of a metal or metalloid which are further described in U.S. Pat. No. 4,751,138 to Tumey (column 6 line 65 to column 9 line 45). Another example is an organometallic salt and an onium salt is described in U.S. Pat. No. 4,985,340 to Palazzotto (column 4 line 65 to column 14 line 50). Still other cationic curing agents include an ionic salt of an organometallic complex in which the metal is selected from the elements of Periodic Group IVB, VB, VIIB, VIIB and VIIIB.

Regarding free radical curable resins, in some instances the abrasive slurry further comprises a free radical curing agent. However in the case of an electron beam energy source, the curing agent is not always required because the electron beam itself generates free radicals.

Examples of free radical thermal initiators include, for example, peroxides, e.g., benzoyl peroxide, azo compounds, benzophenones, and quinones. For either ultraviolet or visible light energy source, this curing agent is sometimes referred to as a photoinitiator. Examples of initiators, that when exposed to ultraviolet light generate a free radical source, include but are not limited to those selected from the group consisting of organic peroxides, azo compounds, quinones, benzophenones, nitroso compounds, acryl halides, hydrozones, mercapto compounds, pyrylium compounds, triacrylimidazoles, bisimidazoles, chloroalkylriazines, benzoin ethers, benzil ketals, thioxanthones, and acetophenone derivatives, and mixtures thereof. Examples of initiators that when exposed to visible radiation generate a free radical source, can be found in U.S. Pat. No. 4,735,632 to Larson, entitled Coated Abrasive Binder Containing Ternary Photoinitiator System. One suitable initiator for use with visible light is "Irgacure 369" commercially available from Ciba Geigy Corporation.

The abrasive slurry can further comprise optional additives, such as, for example, fillers (including grinding aids), fibers, lubricants, wetting agents, thixotropic materials, surfactants, pigments, dyes, antistatic agents, coupling agents, plasticizers, and suspending agents. The amounts of these materials are selected to provide the properties desired. The use of these can affect the erodability of the abrasive composite. In some instances an additive is purposely added to make the abrasive composite more erodable, thereby expelling dulled abrasive particles and exposing new abrasive particles.

The term filler also encompasses materials that are known in the abrasive industry as grinding aids. A grinding aid is defined as particulate material that the addition of which has a significant effect on the chemical and physical processes of abrading which results in improved performance. Examples of chemical groups of grinding aids include waxes, organic halide compounds, halide salts and metals and their alloys. The organic halide compounds will typically break down during abrading and release a halogen acid or a gaseous halide compound. Examples of such materials include chlorinated compounds like tetrachloronaphthalene, pentachloronaphthalene; and polyvinyl chloride. Examples of halide salts include sodium chloride, potassium cryolite, sodium cryolite, ammonium cryolite, potassium tetrafluoroboate, sodium tetrafluoroborate, silicon fluorides, potassium chloride, magnesium chloride. Examples of metals include, tin, lead, bismuth, cobalt, antimony, cadmium, iron titanium. Other miscellaneous grinding aids include sulfur, organic sulfur compounds, graphite and metallic sulfides.

Examples of antistatic agents include graphite, carbon black, vanadium oxide, humectants, and the like. These antistatic agents are disclosed in U.S. Pat. No. 5,061,294 to Harmer; U.S. Pat. No. 5,137,542 to Buchanan, and U.S. Pat. No. 5,203,884 to Buchanan.

A coupling agent can provide an association bridge between the binder precursor and the filler particles or abrasive particles. Examples of coupling agents include silanes, titanates, and zircoaluminates. The abrasive slurry preferably contains anywhere from about 0.01 to 3% by weight coupling agent.

An example of a suspending agent is an amorphous silica particle having a surface area less than 150 meters square/gram that is commercially available from DeGussa Corp., under the trade name "OX-50".

Each abrasive composite has a shape associated with it. The shape has a surface or boundaries associated with it that result in one abrasive composite being separated to some degree from another adjacent abrasive composite. To form an individual abrasive composite, a portion of the planes or boundaries forming the shape of the abrasive composite must be separated from one another. This portion is generally the upper portion. The lower or bottom portion of the abrasive composites abut next to one another. Referring to FIG. 4, adjacent precisely-shaped abrasive composites 110 may be separated near the distal end 160 and abutted near the bottom surface 170. Referring to FIG. 5, a profile end sectional view of an abrasive composite array in an abrasive article 200, adjacent abrasive composites 210 and 220 may be completely separated near their respective top surfaces or apexes 230 and 240, but not at their respective bottom surfaces 250 and 260. There are typically no open spaces between adjacent abrasive composites such that the backing is exposed. The backing 190 is the same as with FIG. 4.

The abrasive composite shape can be any shape. Typically the surface area of the base side of the shape that is in contact with the backing is larger in value than that of the distal end of the composite spaced from the backing. The shape of the composite can be selected from among a number of geometric shapes such as a cubic, cylindrical, prismatic, rectangular, pyramidal, truncated pyramidal, conical, truncated conical, post-like with a top surface which is flat. The resulting abrasive article can have a mixture of different abrasive composite shapes.

In one embodiment, the composite shape is a pyramid, but a truncated pyramid can also be used. The pyramidal shape can have three to five sides if untruncated, and four to six sides if truncated (exclusive of the base side), although a larger number of sides is also possible. Where a pyramidal or truncated pyramidal shape is used as the composite shape, the base side lengths generally can have a length of from about 100 to 500 micrometers.

The height of the composites, in one embodiment, is constant across the array of composites in the abrasive article, but it is possible to have composites of varying heights. The height of the composites generally can be a value up to about 200 micrometers, and more particularly in the range of about 25 to 200 micrometers.

Figure 7:
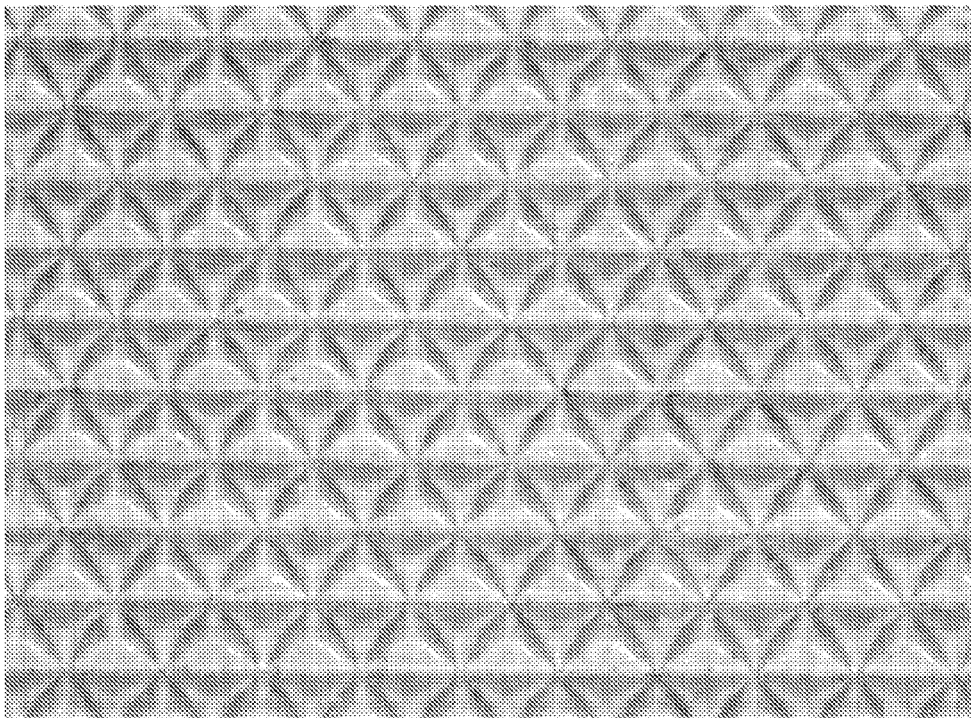
FIG. 7 is a photograph of an abrasive article of the invention made from a production tool having a contacting surface comprising a plasma deposition of a thin film. Approximately 1.4 percent of the apexes are missing.

In one embodiment, the abrasive composites comprised a three-sided, un-truncated pyramidal structure as shown in FIG. 7. The base dimensions of the pyramid measured approximately 154 micrometers, 154 micrometers, and 172 micrometers. The height of the pyramid from the triangular base to the apex measured approximately 63 micrometers. The corresponding area spacing of the precisely-shaped abrasive composites was approximately 8,700 composites per square centimeter.

In one embodiment, the shape of the composite can be precise or predetermined. Such a precise shape is illustrated in FIG. 4. The abrasive article 100 comprises a backing 190 and bonded to the backing are a plurality of precisely-shaped abrasive composites 110, where composites 110 and 120 align in separate rows in the end sectional view of the abrasive article. The abrasive composites are each formed of a plurality of abrasive particles 140 dispersed in a binder 150. In this particular illustration, the abrasive composite has a pyramidal type shape. The planes 180 or boundaries which define the pyramid are very sharp and distinct. The interaction of these well defined, sharp planes or shape boundaries defines a precise shape. In one embodiment of the invention shown in FIG. 4, the abrasive composites are arranged in a staggered arrangement such that row of composites 110 are offset from the next row of composites 120 when viewed in the machine direction of the abrasive article.

In one embodiment, each individual abrasive composite has a cross-sectional surface area that decreases, continuously, away from the backing towards the distal end, i.e., decreases in area size along its height direction in the direction proceeding away from the backing in the perspective of slices of the composite shape taken in a plane parallel to and vertically spaced from the plane of the backing. The height is the distance from the bottom, i.e., where the abrasive composite is bonded to the backing, to the top of the abrasive composite, i.e., the further most distance from the backing. This variable surface area results in a non-uniform pressure as the abrasive composite wears during use. During manufacture of the abrasive article, this variable surface area results in easier release of the abrasive composite from the production tool.

An area spacing of at least 1,200 individual precisely-shaped abrasive composites per square centimeter, or at least about 3,000, or at least about 4,600, or at least about 7,700 precisely-shaped abrasive composites per square cm, or at least 8,500 individual precisely-shaped abrasive composites per square centimeter can be used in the invention. A range of 1,200 to 10,000 precisely-shaped abrasive composites per square centimeter is typical. The recited area spacing of the precisely-shaped abrasive composites results in an abrasive article that has a relatively high rate of cut, while providing a relatively fine surface finish on the workpiece being abraded. Additionally, with this number of precisely-shaped abrasive composites there is a relatively low unit force per each precisely-shaped abrasive composite. In some instances, this can result in better, more consistent, breakdown of the precisely-shaped abrasive composite.

Figure 6:
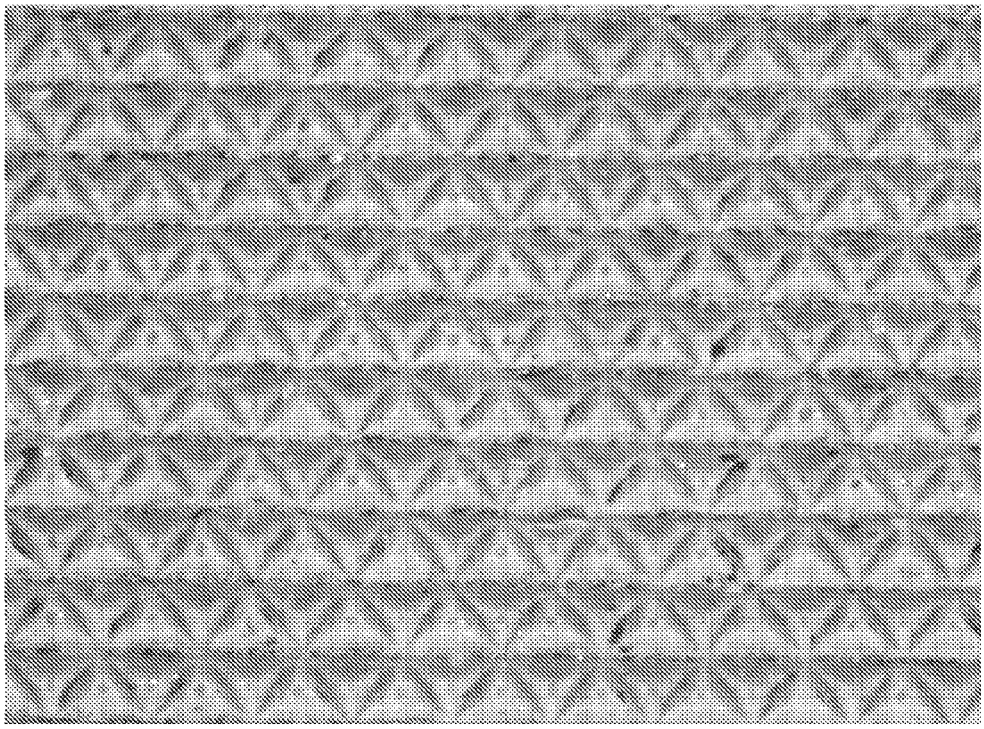
FIG. 6 is a photograph of a prior art abrasive article made from a standard production tool. Approximately 32.2 percent of the apexes are missing.

Additionally, the plasma treatment of at least the contacting surface of the production tooling provides precisely-shaped abrasive composites that are substantially free of precisely-shaped abrasive composite defects. Referring to FIG. 6, an abrasive article made without using a plasma treated production tooling had a Precisely-Shaped Abrasive Composite Defect Rate of approximately 32.2 percent. In particular, the apex of many of pyramids is missing with a small hole or cavity being present instead. Rather than a pyramid, the defective abrasive composite resembled a volcano. Referring to FIG. 7, an abrasive article having abrasive composites made using a production tool having a plasma deposition of a thin film on the abrasive slurry contacting surface has a significant improvement in the Precisely-Shaped Abrasive Composite Defect Rate. Approximately 1.2 percent of the pyramids had a small hole or cavity at the apex instead of being fully formed. In various embodiments of the invention, the Precisely-Shaped Abrasive Composite Defect Rate of the abrasive article can be from 0 percent to about 30 percent, or from 0 percent to about 25 percent, or from 0 percent to about 20 percent, or from 0 percent to about 15 percent, or from 0 percent to about 10 percent, or from 0 percent to about 5 percent, or from 0 percent to about 2 percent.

EXAMPLES

Objects and advantages of this invention are further illustrated by the following non-limiting examples, but the particular materials and amounts thereof recited in these examples, as well as other conditions and, details, should not be construed to unduly limit this invention. Unless otherwise noted, all parts, percentages, ratios, etc. in the Examples and the rest of the specification are by weight.

Production tooling used to make abrasive articles having a plurality of precisely-shaped abrasive composites was treated in a plasma apparatus to impart a covalently bound silicon-containing surface on the polymer surface first by using a mixture of tetramethylsilane (TMS) and either oxygen or nitrogen. The batch plasma treatment was done in a Plasmatherm Batch Reactor. Details of the plasma apparatus and plasma treatment conditions are provided below:

1) Plasmatherm Batch Reactor: This is a commercial batch plasma system (Plasmatherm Model 3032) configured for reactive ion etching (RIE) with a 26-inch lower powered electrode and central gas pumping. The chamber is pumped by a roots blower (Edwards Model EH1200) backed by a dry mechanical pump (Edwards Model iQDP80). RF power is delivered by a 5 kW, 13.56 Mhz solid-state generator (RFPP Model RF50S0 through an impedance matching network. The system has a nominal base pressure of 5 mTorr. The flow rates of the gases are controlled by MKS flow controllers. Substrates for deposition are placed on the lower powered electrode.

2) Plasma Treatment Method: Sheet samples of the polypropylene production tooling were taped to the powered electrode of the batch plasma apparatus. The plasma treatment was done with a mixture of gases: tetramethylsilane and either oxygen or nitrogen. The conditions of the plasma treatment are listed in Table 1. In some embodiments, the plasma treatment was done in two sequential steps as detailed in the table.

3) After the plasma treatment was completed, the chamber was vented to atmosphere and the production tools were removed from the electrode.

Performance of the plasma treated tooling was evaluated using the following abrasive slurry.

Materials:

| | |
|---|---|
| ACR1 | 2-phenoxyethyl acrylate, obtained from Aldrich Chemical Co., Milwaukee, WI; |
| ACR2 | trimethylolpropane triacrylate, obtained from Aldrich Chemical Co., Milwaukee, WI; |
| BIN6 | a UV curable resin pre-mix consisting of 49 parts of ACR2, 33 parts of ACR1, 3 parts UV1, 8 parts OX50, 2 parts DSP1 and 5 parts CPA1; |
| CPA1 | Methacrylate-functional silane monomer, "SILANE A-174NT", obtained from Momentive Performance Materials, Friendly, West Virginia; |
| DSP1 | a 100 percent active polymeric dispersant, available under the trade designation "SOLPLUS D520" from Lubrizol Corporation, Wickliffe, OH; |
| MIN7 | green silicon carbide mineral, $D_{50}$ = 4.0 +/− 0.5 micrometers, commercially available under the trade designation "GC 3000 GREEN SILICON CARBIDE" from Fujimi Corporation, Elmhurst, IL; |
| UV1 | acylphosphine oxide photoinitiator, commercially available under the trade designation "LUCERIN TPO-L" from BASF Corporation, Florham Park, New Jersey; |
| OX50 | Silicon dioxide filler, "Aerosil OX-50", obtained from Degussa Corporation, Parsippany, New Jersey. |

An abrasive slurry defined in parts by weight, was prepared as follows: 43.1 parts premix BIN6 and 58.7 parts MIN7 were homogeneously dispersed for 1 hour at 27 degrees C. using a jacketed high sheer mixer with side wall scrapers.

In one embodiment, the above abrasive slurry was applied to samples of plasma treated polypropylene production tooling. The size of the plasma treated polypropylene production tooling was approximately 3 inches by 6 inches. The production tooling had a plurality of cavities that formed precisely-shaped abrasive composites that comprised a three-sided, un-truncated pyramidal structure as shown in FIG. 7. The base dimensions of the pyramid measured approximately 154 micrometers, 154 micrometers, and 172 micrometers. The height of the pyramid from the triangular base to the apex measured approximately 63 micrometers. The corresponding area spacing of the precisely-shaped abrasive composites was approximately 8,700 composites per square centimeter.

The abrasive slurry was applied to the production tooling surface (recessed features in the tooling) with a tongue depressor by pushing abrasive slurry into the cavities. An area approximately 2 inches by 4 inches (5.1 cm by 10.2 cm) was coated. A slight excess of abrasive slurry was applied so that a smooth layer was formed. A 4 inch by 6 inch (10.2 cm by 15.2 cm) piece of primed PET 3 mil film (prime side touching) was laid over the slurry filled tooling. A 1.5 inch (3.8 cm) wide rubber hand roller was used to force the slurry into the recesses of the cavity and to minimize the coating thickness at the film tooling interface. These hand spread samples were taped to a metal sheet 12 inches by 6 inches (30.5 cm by 15.2 cm), tooling side up. The abrasive slurry was cured by passing the prepared samples on a conveyor under one high powered Fusion lamp equipped with a 600 watt "D" bulb at a belt speed of 30 feet per minute (9.1 meters per minute). Each sample was passed under the lamp twice.

The samples were allowed to cool and the production tooling was removed from the cured structured abrasive layer. The samples were rated for release from the production tooling and for fill appearance under an optical microscope as recorded in Table 1. For some samples, the cured structured abrasive layer had transferred to the PET primed film. While using the plasma treated production tooling, the performance of the tooling was judged relative to the untreated polypropylene tooling and past experience with many different types of production tooling. The fill property (propensity to create a precisely-shaped abrasive composite defect) and the release properties of the tooling were qualitatively evaluated on a 1 to 5 scale with 5 being the best. Desirably, the release properties of the plasma treated production tooling should be the same or similar to polypropylene for ease of removing the precisely-shaped abrasive composites from the cavities in the production tooling. The fill property of the untreated polypropylene tooling was judged to be a 2. Any treatment resulting in a fill number greater than 2 will have a corresponding lower number of precisely-shaped abrasive composite defects.

TABLE 1

Plasma Treatment Conditions for the Batch Reactor

| Run No. | No. Steps | Gas | Flow Rate, sccm | Pressure, mTorr | Power watts | Time | Plasma Type | Fill | Release |
|---|---|---|---|---|---|---|---|---|---|
| 17 | | $O_2$ | 500 | 50 | 1000 | 2 min | Etching | 1 | 4 |
| 18 | | $N_2$ | 500 | 50 | 1000 | 2 min | Hydrophilic | 3 | 4 |
| 19 | | TMS<br>$N_2$ | 150<br>500 | 60 | 1000 | 1 min | a-Si:C:N:H | 3 | 5 |
| 20 | 1 | TMS<br>$N_2$ | 150<br>500 | 60 | 1000 | 1 min | a-Si:C:N:H | | |
| 20 | 2 | $N_2$ | 500 | 50 | 1000 | 9 min | | 4 | 2 |
| 21 | | TMS<br>$O_2$ | 150<br>500 | 60 | 1000 | 1 min | 150 sccm TMS in O2 | 2 | 5 |
| 22 | 1 | TMS<br>$O_2$ | 150<br>500 | 60 | 1000 | 1 min | Hydrophilic DLG | | |
| 22 | 2 | $O_2$ | 500 | 50 | 1000 | 1 min | | 3 | 1 |
| 23 | | TMS | 50 | 55 | 1000 | 1 min | 50 sccm TMS | 5 | 5 |

TABLE 1-continued

| Plasma Treatment Conditions for the Batch Reactor | | | | | | | | |
|---|---|---|---|---|---|---|---|---|
| | $O_2$ | 500 | | | | in O2 | | |
| 24 | TMS | 100 | 60 | 1000 | 1 min | 100 sccm TMS | 4 | 5 |
| | $O_2$ | 500 | | | | in O2 | | |
| 25 | TMS | 100 | 60 | 1000 | 1 min | a-Si:C:N:H | 3 | 5 |
| | $N_2$ | 500 | | | | | | |
| 26 | TMS | 50 | 55 | 1000 | 1 min | Med TMS in N2 | 3 | 4 |
| | $N_2$ | 500 | | | | | | |
| Control | | | | | | none | 2 | 5 |

| Run No. | Fill | Release | Surface Tension dynes/cm |
|---|---|---|---|
| 17 | 1 | 4 | |
| 18 | 3 | 4 | |
| 19 | 3 | 5 | 34 |
| 20 | 4 | 2 | 50 |
| 21 | 2 | 5 | 35 |
| 22 | 3 | 1 | >70 |
| 23 | 5 | 5 | 66 |
| 24 | 4 | 5 | 37 |
| 25 | 3 | 5 | 35 |
| 26 | 3 | 4 | >70 |
| Control | 2 | 5 | 32 |

Several different plasma treatments of the polypropylene production tooling were evaluated. The wetting tension for each production tooling in Table 1 was measured using wetting tension test solutions made by Enercon Industries Corporation. The test solutions were applied using cotton swabs to spread the solutions onto the production tooling in accordance with ASTM D2578-04a "Standard Test Method for Wetting Tension of Polyethylene and Polypropylene Films." Measurements were taken on the flat backside of the production tooling (both sides were plasma treated) due to the difficulty of measuring the inside of the small cavities.

By using a plasma treatment gas comprising TMS/O2 or TMS/N2 it is possible to improve the fill property of the production tooling without degrading the release property. In particular, run numbers 23-25 had excellent release properties and improved fill properties over the control. It is believed this result was due in part to changing the wetting tension of the contacting surface of the tooling from 32 dynes/cm to 34 dynes/cm or greater. In various embodiments of the invention, the wetting tension of the production tooling can be between 34 dynes/cm to 70 dynes/cm, or between 35 dynes/cm to 68 dynes/cm. Surprisingly, even though the wetting tension was increased, it was possible to achieve excellent release of the cured acrylate abrasive slurry from the plasma treated contacting surface for some embodiments. However, simply increasing the wetting tension of the production tooling did not always result in acceptable release of the abrasive composites from the production tooling as shown by run numbers 20 and 22.

In another embodiment, the above abrasive slurry was applied via knife coating to a 12-inch (30.5 cm) wide microreplicated plasma treated polypropylene tooling. The production tooling had a plurality of cavities that formed precisely-shaped abrasive composites that comprised a three-sided, un-truncated pyramidal structure as shown in FIG. 7. The base dimensions of the pyramid measured approximately 154 micrometers by 154 micrometers by 172 micrometers. The height of the pyramid from the triangular base to the apex measured approximately 63 micrometers. The corresponding area spacing of the precisely-shaped abrasive composites was approximately 8,700 composites per square centimeter. The production tool was prepared from a corresponding master roll generally according to the procedure of U.S. Pat. No. 5,975,987 to Hoopman et al.

The abrasive slurry-filled polypropylene tooling was then laid on a 12-inch (30.5-cm) wide web of ethylene acrylic acid-primed polyester film, 3.71 mil (94.2 micrometers) thick, obtained under the trade designation "MA370M" from 3M Company, passed through a nip roll (nip pressure of 90 pounds per square inch (psi) (620.5 kilopascals (kPa)) for a 10 inch (25.4 cm) wide web), and irradiated with an ultraviolet (UV) lamp, type "D" bulb, from Fusion Systems Inc., Gaithersburg, Md., at 600 Watts/inch (236 Watts/cm) while moving the web at 30 feet/minute (fpm) (9.14 meters/minute). The polypropylene tooling was separated from the ethylene acrylic acid-primed polyester film, resulting in a fully cured precisely-shaped abrasive composite layer adhered to ethylene acrylic acid primed polyester film.

Table 3 below presents the results for rolls of production tooling treated using a continuous plasma reactor and an untreated control sample. The rolls were treated using a continuous plasma reactor as described in U.S. Pat. No. 7,195,360 to Bacon. This continuous plasma reactor included a vacuum chamber pumped by a roots blower (Leybold Model WSU1000) backed by a dry mechanical pump (Edwards Model iQDP80) with a base pressure of 10 mTorr. The substrate web was wrapped around one of the two drum electrodes located within the chamber. A concentric ground electrode was provided around each of the drum electrodes. Before pumping the chamber, the roll of substrate web was mounted on the unwind chuck, the web wrapped around the top electrode and taped to the take-up roll. The web tension was set to the desired value of 0.025 lb/in, the chamber closed and pumped down to a pressure of 200 mTorr before introducing the gases at the prescribed flow rates listed in Table 3. Once the required gas flow rate was established, the RF power was turned on to ignite the plasma and the power maintained at the prescribed level of either 1250 or 2500 watts. Once the plasma conditions were established, the web was translated at the desired speed specified in Table 3. At the end of the plasma treatment run, the gases were disabled, the chamber pumped back down to its base pressure of 10 mTorr, and the chamber isolated from the pumping system and vented to atmosphere.

The treated roll was taken out and the production tooling was used in the processing describe above to produce the abrasive articles.

Each of the run conditions resulted in plasma treated production tooling having excellent fill properties and release properties. Moreover, it was possible to reuse the tooling to make structured abrasive articles at least three times without appreciable loss in performance. The Precisely-Shaped Abrasive Composite Defect Rate was determined for the abrasive articles made from each of the plasma treated production tooling and from the untreated polypropylene production tooling. Commercially available abrasive articles, available from 3M, Saint Paul, Minn., having a plurality of precisely-shaped abrasive composites were also examined to measure the Precisely-Shaped Abrasive Composite Defect Rate for each sample. The commercially available samples had the properties as shown in Table 2 below. Three different 10×10 arrays (100 total composites in each array) were randomly selected from each comparative example or commercial sample for examination.

As seen, the Precisely Shaped Abrasive Composite Defect Rate was significantly reduced for the structured abrasive articles made from the plasma treated tooling. The Precisely-Shaped Abrasive Composite Defect Rate was less than 2 percent for each abrasive article produced from the plasma treated tooling while the lab experimental control sample had a defect rate of 40 percent and the commercially available samples had defect rates between 63 percent and 98 percent.

TABLE 2

Commercial Sample Details

| Example | Description | Feature geometry | Ave. Base Dimensions, mils, (micrometers) | No. of features per square cm | Feature height, mils (micrometers) |
|---|---|---|---|---|---|
| Comparative Sample A | 305EA, grade A3, run OC2 | Square Pyramidal | 29 (736.6) | 159 | 20 (508) |
| Comparative Sample B | 466LA, grade A5, run AO1 | Triangular Pyramidal | 7.75 × 7.75 × 6.89 (196.85 × 196.85 × 175.01) | 7789 | 2.5 (63.5) |
| Comparative Sample C | 466LA, grade A5, run AT5 | Triangular Pyramidal | 7.75 × 7.75 × 6.89 (196.85 × 196.85 × 175.01) | 7789 | 2.5 (63.5) |
| Comparative Sample D | 217EA, grade A100, run IN3 | Square Pyramidal | 27.6 (701.04) | 203 | 18 (457.2) |
| Comparative Sample E | 237AA, grade A30, run NS1 | Square Pyramidal | 21.5 (546.1) | 335 | 14 (355.6) |

TABLE 3

Continuous Plasma Treatment Conditions and Precisely Shaped Abrasive Composite Defect Rate

| Roll No. | Gas | Flow Rate sccm | Pressure | Power watts | Speed fpm | Defects % |
|---|---|---|---|---|---|---|
| 1 | TMS<br>O2 | 200<br>2000 | 200 mTorr | 1250 | 10 | 0.7 |
| 2 | TMS<br>O2 | 200<br>2000 | 200 mTorr | 1250 | 20 | 0.0 |
| 3 | TMS<br>O2 | 200<br>2000 | 200 mTorr | 1250 | 30 | 1.3 |
| 4 | TMS<br>O2 | 200<br>2000 | 200 mTorr | 1250 | 40 | 1.0 |
| 5 | TMS<br>O2 | 200<br>2000 | 200 mTorr | 1250 | 50 | 1.6 |
| 6 | TMS<br>O2 | 200<br>2000 | 200 mTorr | 2500 | 50 | 1.0 |
| 7 | TMS<br>O2 | 200<br>2000 | 200 mTorr | 2500 | 40 | 1.0 |
| 8 | TMS<br>O2 | 200<br>2000 | 200 mTorr | 2500 | 30 | 0.7 |
| 9 | TMS<br>O2 | 200<br>2000 | 200 mTorr | 2500 | 20 | 0.3 |
| 10 | TMS<br>O2 | 200<br>2000 | 200 mTorr | 2500 | 10 | 1.0 |
| Control | n.a. | n.a. | n.a. | n.a. | n.a. | 40.0 |
| Comparative A | n.a. | n.a. | n.a. | n.a. | n.a. | 72 |
| Comparative B | n.a. | n.a. | n.a. | n.a. | n.a. | 65 |
| Comparative C | n.a. | n.a. | n.a. | n.a. | n.a. | 78 |
| Comparative D | n.a. | n.a. | n.a. | n.a. | n.a. | 98 |
| Comparative E | n.a. | n.a. | n.a. | n.a. | n.a. | 75 |

Precisely-Shaped Abrasive Composite Defect Rate

Abrasive articles having a layer of precisely-shaped abrasive composites were examined under a stereomicroscope. At least 100 individual precisely-shaped abrasive composites and preferably at least 200 precisely-shaped abrasive composites in at least three randomly-selected areas of the abrasive article were examined. The images were examined to determine the presence or absence of a precisely-shaped abrasive composite defect in each of the precisely-shaped abrasive composites. The number of precisely-shaped abrasive composite defects was counted for each of the three areas along with the total number of precisely-shaped abrasive composites that were examined. The precisely-shaped abrasive composite defect is expressed as a percentage of the total number of defects to the total number of precisely-shaped abrasive composites that were counted in all three areas (total number of defective composites counted/total number of composites counted*100).

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part or combined with other aspects of the various embodiments. All cited references, patents, or patent applications in the above application for letters patent are herein incorporated in their entirety by reference in a consistent manner. In the event of inconsistencies or contradictions between the incorporated references and this application, the information in the preceding description shall control. The preceding description, in order to enable one of ordinary skill in the art to practice the claimed invention, is not to be construed as limiting the scope of the invention, which is defined by the claims and all equivalents thereto.

What is claimed is:

1. A method of making an abrasive article comprising: treating a plurality of cavities in a contacting surface of a production tool by plasma deposition of a thin film comprising an amorphous hydrogenated silicon oxycarbide thereby forming a plurality of plasma treated cavities; filling the plurality of plasma treated cavities in the production tool with an abrasive slurry; and at least partially c ring the abrasive slurry while residing in the plurality of cavities.

2. The method of claim 1 further comprising: mixing he abrasive slurry comprising abrasive particles and a binder precursor; contacting the abrasive slurry in the production tool with a backing; at least partially curing the binder precursor to form a shaped, handleable structure; and separating the shaped, handleable structure from the production tool.

3. The method of claim 1 wherein the plurality of cavities comprises an area spacing greater than about 1,200 cavities per square cm.

4. The method of claim 1 wherein the contacting surface containing the plurality of cavities has a wetting tension of 34 dynes/cm or greater.

5. The method of claim 2 wherein the plasma deposition comprises a silicon-containing first gas and a reactive second gas selected from the group consisting of oxygen and nitrogen.

6. The method of claim 5 wherein the silicon-containing first gas is tetramethylsilane.

7. The method of claim 6 wherein the reactive second gas is oxygen.

8. The method of claim 7 wherein a ratio of the flow ate of the silicon-containing first gas divided by the flow rate of the reactive second gas is between about 0.05 to about 0.25.

9. The method of claim 8 wherein the contacting surface of the production tool has a wetting tension of between 35 dynes/cm to 68 dynes/cm.

10. The method of claim 5 wherein a ratio of the flow rate of the silicon-containing first gas divided by the flow rate of the reactive second gas is between about 0.05 to about 0.35.

11. The method of claim 4 wherein the plurality of cavities comprises an area spacing greater than about 1,200 cavities per square cm.

12. The method of claim 1 wherein the thin film is about 1 nm to about 100 nm thick.

* * * * *

UNITED STATES PATENT AND TRADEMARK OFFICE

CERTIFICATE OF CORRECTION

PATENT NO. : 8,080,073 B2
APPLICATION NO. : 12/140402
DATED : December 20, 2011
INVENTOR(S) : Moses M. David et al.

It is certified that error appears in the above-identified patent and that said Letters Patent is hereby corrected as shown below:

Column 5
Line 36, delete "VIIB," and insert -- VIB, --, therefor.

Column 12
Line 19, delete "alpha." and insert -- .alpha. --, therefor.

Column 13
Line 4, delete "methyacryloxyethyl" and insert -- methylacryloxyethyl --, therefor.
Line 50, delete "VIIB," and insert -- VIB, --, therefor.
Line 65, delete "hydrozones" and insert -- hydrazones --, therefor.
Line 66, delete "chloroalkylriazines" and insert -- chloroalkyltriazines --, therefor.

Column 14
Line 32, delete "tetrafluoroboate" and insert -- tetrafluoroborate --, therefor.

Column 23
Line 23, in Claim 1, delete "c ring" and insert -- curing --, therefor.
Line 25, in Claim 2, delete "he" and insert -- the --, therefor.

Column 24
Line 15, in Claim 8, delete "ate" and insert -- rate --, therefor.

Signed and Sealed this
Twenty-eighth Day of February, 2012

David J. Kappos

David J. Kappos
*Director of the United States Patent and Trademark Office*